United States Patent [19]

Harmsen et al.

[11] 4,149,883

[45] Apr. 17, 1979

[54] ELECTRICAL CONTACT

[75] Inventors: Nils Harmsen, Bruckhköbel; Franz Sperner, Hanau am Main, both of Fed. Rep. of Germany

[73] Assignee: W. C. Heraeus GmbH, Hanau am Main, Fed. Rep. of Germany

[21] Appl. No.: 819,492

[22] Filed: Jul. 27, 1977

[30] Foreign Application Priority Data

Aug. 20, 1976 [DE] Fed. Rep. of Germany ..... 2637490

[51] Int. Cl.[2] ..... C22C 5/06

[52] U.S. Cl. ..... 75/173 R; 75/172 G

[58] Field of Search ..... 75/172 G, 173 R, 173 C, 75/134 N

[56] References Cited

U.S. PATENT DOCUMENTS

| | | | |
|---|---|---|---|
| 1,965,012 | 7/1934 | Taylor | 75/172 G |
| 2,048,648 | 7/1936 | Feussner | 75/172 G |
| 3,929,475 | 12/1975 | Ingersoll | 75/173 R |

*Primary Examiner*—L. Dewayne Rutledge
*Assistant Examiner*—Peter K. Skiff
*Attorney, Agent, or Firm*—Flynn & Frishauf

[57] ABSTRACT

The present invention provides electrical contacts having at least one contact surface consisting essentially of a silver palladium alloy containing 10–50 percent by weight palladium, 0.1–8 percent copper, 0.1–6 percent indium, 0.1–6 percent tin, and the balance essentially silver.

5 Claims, 1 Drawing Figure

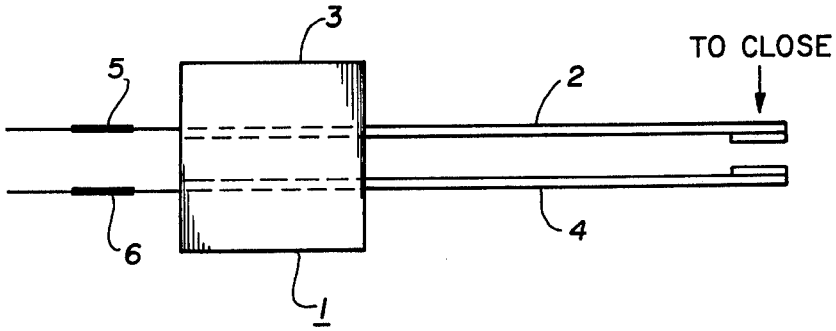
3
5
2
TO CLOSE
4
6
1

ELECTRICAL CONTACT

The present invention relates to silver-palladium alloys and more particularly to electrical contacts utilizing silver-palladium alloys.

Alloys of silver and palladium are known contact materials in the measuring and control technology. With a palladium content of 30% they are substantially resistant to the effects of sulfur. Their strength characteristics can be improved by additions of copper. A known copper-containing silver-palladium contact alloy consists of 65% silver, 30% palladium and 5% copper (A. Keil: *Werkstoffe fuer elektrische Kontakte,* "Materials for Electrical Contacts," Springer-Verlag, Berlin/Gottingen/Heidenlberb, 1960, page 157). If, for further improvement of the strength, the copper content of these alloys is increased, the danger arises that their resistance to tarnishing and to corrosion is considerably decreased.

It is an object of the invention to provide silver-palladium alloys having improved strength without decreasing the resistance to attack by corrosion. It is a further object of the invention to provide contact materials with at least one contact surface comprising an alloy of the present invention.

THE INVENTION

The present invention provides alloys consisting essentially of between about 10% and 60% preferably between 10% and 50% by weight palladium, about 0.1% and 8% copper, about 0.1% and 6% indium, about 0.1% and 6% tin, and the balance essentially silver.

Particularly preferred alloys contain (i) 59.8% by weight silver, 30% palladium, 5% copper, 5% indium and 0.2% tin; and (ii) of 59.8% by weight silver, 30% palladium, 5% copper, 0.2% indium and 5% tin.

The aforesaid alloys have good electrical contact utility and excellent resistance characteristics. They have also very good elasticity, i.e., springlike characteristics, which makes them suitable for use in miniaturized components, especially for use as switch contacts. This utilizes both their excellent contact and elasticity characteristics. They are also useful for other contacts, such as output contacts, pick-off contacts, etc.

The excellent physical characteristics of the two preferred alloys set forth hereinbefore are illustrated in the Table which is the last page of the specification. For comparison purposes, the Table also specifies the corresponding properties of the known contact alloys containing (i) 70% slver-30% palladium, and (ii) 65% silver, 30% palladium, and 5% copper.

The invention, particularly with reference to the contacts, will be described by way of example with reference to the accompanying drawing, wherein the single figure is a schematic, cross-section view of a contact.

Normally open switch 1 includes spring contact sheet 2 comprising the silver-palladium of this invention held in insulating block 3, which also holds the rigid contact 4. Terminals 5 and 6 are connected to contacts 2 and 4, respectively. When pressure is applied to spring contact 2 in the direction of the arrow, the circuit is closed, and when the pressure is removed, contact is broken.

Preferred alloys of the present invention contain between about 20% and 35% palladium, about 2% and 6% copper, about 0.2% and 5% indium, about 0.2% and 5% tin, and balance is silver.

TABLE

| | | AgPd 70/30 | AgPdCu 65/30/5 | AgPdCuInSn 59.8/30/5/5/0,2 | AgPdCuInSn 59.8/30/5/0.2/5 |
|---|---|---|---|---|---|
| Density | | | | | |
| [g . cm$^{-3}$] | | 10.9 | 10.8 | 10.5 | 10.5 |
| Electrical Conductivity | a | 6.5 | 6.4 | 5.7 | 6.3 |
| [mΩ$^{-1}$mm$^{-2}$] | b | 6.3 | 6.6 | 5.6 | 6.3 |
| Hardness | a | 180 | 225 | 255 | 265 |
| [kp . mm$^{-2}$] | b | 55 | 90 | 145 | 135 |
| | c | — | 245 | 345 | 330 |
| Tensile Strength | a | 630 | 810 | 905 | 970 |
| [N . mm$^{-2}$] | b | 310 | 420 | 535 | 510 |
| | c | — | — | 1050 | 1095 |
| Elasticity Limit | a' | — | 330 | 430 | 420 |
| [N . mm$^{-2}$] | c | — | — | 800 | 850 |

a = hard
a' = 70% deformed
b = soft
c = tempered

We claim:

1. Electrical contact having at least one contact surface consisting essentially of between about 10% and 60% by weight palladium, between about 0.1 and 8% copper, between about 0.1 and 6% indium, between about 0.1 and 6% tin, and the balance essentially silver.

2. Electrical contact of claim 1 having said at least one contact surface consisting essentially of 59.8% silver, 30% palladium, 5% copper, 5% indium, and 0.2% tin.

3. Electrical contact of claim 1 having said at least one contact surface consisting essentially of 59.8% silver, 30% palladium, 5% copper, 0.2% indium, and 5% tin.

4. Electrical contact of claim 1 having said at least one contact surface consisting essentially of between about 20% and 35% palladium, between 2% and 6% copper, between about 0.2% and 5% indium, and between about 0.2% and 5% tin.

5. Electrical contact of claim 1 having said at least one contact surface containing between 10% and 50% of palladium.

* * * * *